US008989606B2

(12) United States Patent
Kato

(10) Patent No.: US 8,989,606 B2
(45) Date of Patent: Mar. 24, 2015

(54) IMAGE FORMING APPARATUS HAVING PREFERENCE CONTROL UNIT

(75) Inventor: Hiroshi Kato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 148 days.

(21) Appl. No.: 13/185,837

(22) Filed: Jul. 19, 2011

(65) Prior Publication Data

US 2012/0020679 A1 Jan. 26, 2012

(30) Foreign Application Priority Data

Jul. 26, 2010 (JP) ..... 2010-167074

(51) Int. Cl.
*G03G 15/00* (2006.01)
*G03G 15/01* (2006.01)

(52) U.S. Cl.
CPC ..... *G03G 15/0121* (2013.01); *G03G 15/5087* (2013.01); *G03G 2215/00109* (2013.01); *G03G 2215/0141* (2013.01); *G03G 2215/0695* (2013.01); *G03G 2221/1663* (2013.01)
USPC ..... 399/13; 399/54

(58) Field of Classification Search
USPC ..... 399/12, 13, 27, 54, 223
See application file for complete search history.

(56) References Cited

U.S. PATENT DOCUMENTS 6,212,340 B1 * 4/2001 Sugimoto et al. ..... 399/27
7,065,304 B2 * 6/2006 Taguchi ..... 399/12
7,236,725 B2 * 6/2007 Inukai et al. ..... 399/223
2005/0163515 A1 * 7/2005 Inukai ..... 399/12
2005/0201764 A1 * 9/2005 Okamoto et al. ..... 399/12
2005/0260007 A1 * 11/2005 Shimomura ..... 399/55
2006/0120736 A1 * 6/2006 Kakuno et al. ..... 399/27

FOREIGN PATENT DOCUMENTS

JP 2001-130053 5/2001
JP 2003-316106 A 11/2003
JP 2005-201990 A 7/2005
JP 2005-331741 A 12/2005

* cited by examiner

*Primary Examiner* — Clayton E LaBalle
*Assistant Examiner* — Victor Verbitsky
(74) *Attorney, Agent, or Firm* — Kubotera & Associates, LLC

(57) ABSTRACT

An image forming apparatus includes an image forming portion capable of mounting a plurality of first image forming units for forming images in different colors or a plurality of second image forming units for forming images in a single color. The first image forming units and the second image forming units are arranged to be exchangeable. The first image forming units retain toner in different colors, and the second image forming units retain toner in the single color. The image forming apparatus further includes a preference control unit for leaving at least one of the second image forming units unused and preferentially using rest of the second image forming units when the first image forming units are exchanged to the second image forming units in a monochrome printing operation.

12 Claims, 12 Drawing Sheets

IMAGE FORMING APPARATUS HAVING PREFERENCE CONTROL UNIT

BACKGROUND OF THE INVENTION AND RELATED ART STATEMENT

The present invention relates to an image forming apparatus. More specifically, the present invention relates to an image forming apparatus provided with image forming units capable of forming an image in different colors (for example, a tandem-type color printer).

In a conventional image forming apparatus capable of forming an image (for example, a tandem-type color printer), there are provided image forming units in different colors such as cyan (C), magenta (M), yellow (Y) and black (K) (also referred to as an image drum formed of an integrated unit of a photosensitive member, a toner cartridge, and the like); an LED (Light Emitting Diode) head combined with each of the image forming units for exposure; a transfer portion disposed below each of the image forming units; and a fixing portion disposed a backside of the transfer portion. When the conventional image forming apparatus performs a printing operation, it is possible to perform a color printing operation at a speed the same as that in a monochrome printing operation.

In term of usage frequency of the conventional image forming apparatus, the printing operation tends to be performed far more often for the color printing operation than the monochrome printing operation. Accordingly, black (K) toner tends to be consumed more than other color toner. As a result, the image forming unit in black (B) is replaced more frequently for replenishing black (K) toner.

As one of counter measures, Patent Reference has disclosed a conventional configuration, in which image forming units in colors are converted into an image forming unit for black, and only the image forming unit for black is used in a way similar to a monochrome printer.

Patent Reference: Japanese Patent Publication No. 2001-130053

According to Patent Reference, the conventional image forming apparatus is a tandem-type printer capable of performing a color printing operation and a monochrome printing operation. The conventional image forming apparatus includes a plurality of LED heads capable of printing per line; a unit for transferring a monochrome dot data row of one line to each of the LED heads; and a print control unit for controlling each of the LED heads to print only a specific dot area in a dot area of one line according to the monochrome dot data so that the LED heads divide the monochrome dot data row of one line. It is noted that the dot data are raster data for one line to be printed on a printing medium.

In the conventional image forming apparatus described above, when the image forming units are changed from multiple color to monochrome, an amount of toner in the monochrome color increases, thereby prolonging life of toner. Further, when the monochrome dot data row of one line are divided and used per image forming unit, a printing area is divided and becomes smaller, thereby increasing a printing speed as opposed to a case in which one image forming unit is used for one entire line.

As explained above, in the conventional image forming apparatus, toner in each of the image forming units is divided and used uniformly for increasing the printing speed. Accordingly, toner in each of the image forming units is consumed uniformly. There may be a case, however, in which it is necessary to change the image forming units from monochrome to multiple color before toner in the image forming units is completely consumed. In this case, the image forming unit for multiple color is replaced with a new image forming unit. When toner still remains in the image forming unit for monochrome (K), it is possible to continue to use the image forming unit, thereby making it possible not to replace the image forming unit.

As explained above, when it is necessary to perform the color printing operation, it is necessary to change the image forming units from monochrome to multiple color while the image forming unit for monochrome (K) is not replaced. In this case, toner in the image forming unit for monochrome (K) is completely consumed earlier, thereby making it necessary to replace the image forming unit for monochrome (K).

In view of the problems described above, an object of the present invention is to provide an image forming apparatus capable of solving the problems of the conventional image forming apparatus.

Further objects and advantages of the invention will be apparent from the following description of the invention.

SUMMARY OF THE INVENTION

In order to attain the objects described above, according to a first aspect of the present invention, an image forming apparatus includes an image forming portion capable of mounting a plurality of first image forming units for forming images in different colors or a plurality of second image forming units for forming images in a single color. The first image forming units and the second image forming units are arranged to be exchangeable. The first image forming units retain toner in different colors, and the second image forming units retain toner in the single color. The image forming apparatus further includes a preference control unit for leaving at least one of the second image forming units unused and preferentially using rest of the second image forming units when the first image forming units are exchanged to the second image forming units in a monochrome printing operation.

In the first aspect of the present invention, the image forming apparatus includes the preference control unit for leaving at least the one of the second image forming units unused and preferentially using the rest of the second image forming units when the first image forming units are exchanged to the second image forming units in the monochrome printing operation.

In the first aspect of the present invention, when the second image forming units are switched back to the first image forming units in a color printing operation while each of the second image forming units still retains toner, the one of the second image forming units does not consume toner in the previous printing operation. Accordingly, it is possible to use the one of the second image forming units from the previous state, and to prolong life of one of the second image forming units. As a result, it is possible to reduce the number of exchanges between the first image forming units and the second image forming units.

According to a second aspect of the present invention, an image forming apparatus is capable of performing a limited color printing operation and a multiple color printing operation In the second aspect of the present invention, the image forming apparatus includes an image forming portion for mounting a first image forming unit for forming an image in a first color. The image forming portion is further capable of mounting a second image forming unit for forming an image in the first color in the limited color printing operation. The image forming portion is further capable of mounting a third image forming unit for forming an image in a second color different from the first color in the multiple color printing operation.

In the second aspect of the present invention, the image forming apparatus further includes a control unit for controlling the image forming portion so that the second image forming unit is preferentially used relative to the first image forming unit in the limited color printing operation.

DETAILED DESCRIPTION OF PREFERRED EMBODIMENTS

Hereunder, embodiments of the present invention will be explained with reference to the accompanying drawings.

First Embodiment

Figure 2:
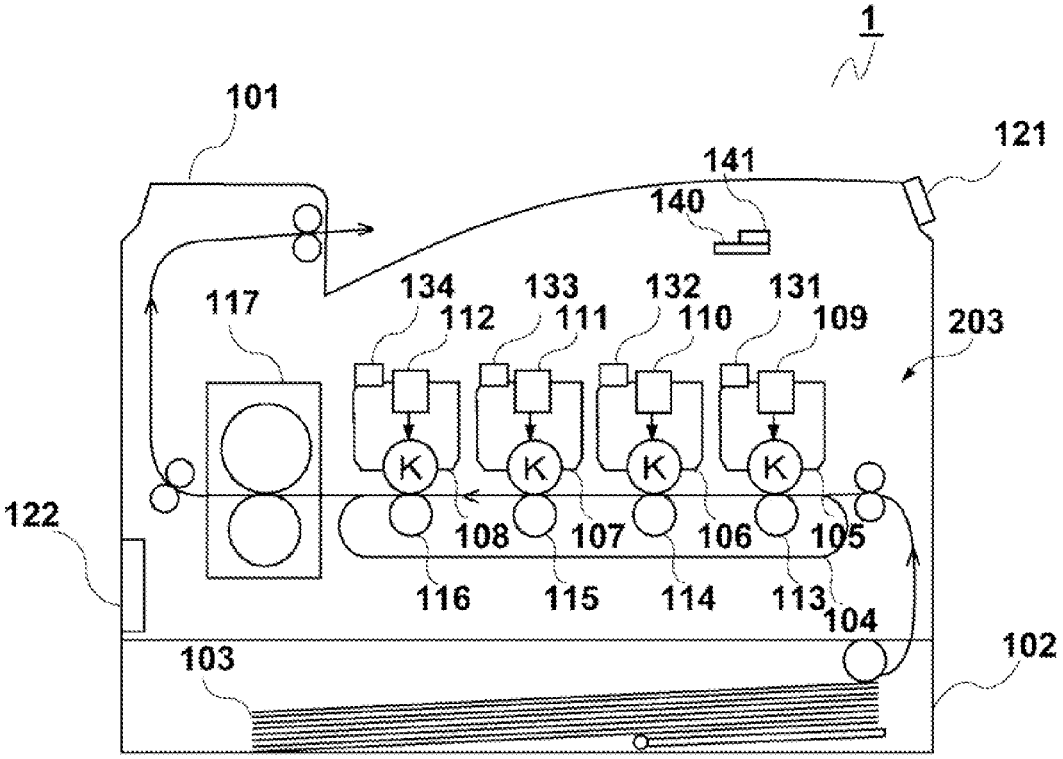
FIG. 2 is a schematic sectional view showing a configuration of the image forming apparatus applied to a printer according to the first embodiment of the present invention.

A first embodiment of the present invention will be explained. FIG. 2 is a schematic sectional view showing a configuration of the image forming apparatus applied to a printer 1 according to the first embodiment of the present invention.

As shown in FIG. 2, the printer 1 includes a housing 101 and an image forming portion 203 disposed in the housing 101. The image forming portion 203 includes image drums 105, 106, 107 and 108 (image forming units) for different colors such as cyan (C), magenta (M), yellow (Y) and black (K); LED (Light Emitting Diode) heads 109, 110, 111 and 112 disposed above each of the image drums 105, 106, 107 and 108 for exposure; transfer portions 113, 114, 115 and 116 disposed below each of the image drums 105, 106, 107 and 108 for transferring developed images to a printing medium 103 (a sheet); and a transportation belt 104.

In the embodiment, the image forming portion 203 further includes a fixing portion 117 for fixing toner transferred to the printing medium 103; a control circuit board 140 disposed above the image drums 105, 106, 107 and 108 and having a use image drum determination unit and a control unit integrated in an integrated circuit; an operation panel 121 disposed on an upper front surface of the housing 101 near the control circuit board 140; and an external interface unit 122 (an I/F) disposed on a lower backside surface of the housing 101 for externally connecting to an external device. Further, the printer 1 includes a tray 102 disposed below the image forming portion 203 for storing the printing medium 103.

In the embodiment, in the image forming portion 203, each of the image drums 105, 106, 107 and 108 includes a photosensitive member (not shown); a charging roller (not shown) disposed around an outer circumferential surface of the photosensitive member for uniformly charging the photosensitive member; a developing roller (not shown) for coating toner on a surface of the photosensitive member thus charged; the developing blade (not shown); a developing blade (not shown); a toner supply sponge roller (not shown); a cleaning blade (not shown) for removing toner on the photosensitive member after transfer; and a toner cartridge for retaining toner. The toner cartridge is configured to be detachable relative to each of the image drums 105, 106, 107 and 108, and may be integrated with the image drums 105, 106, 107 and 108.

In the embodiment, the image drums 105, 106, 107 and 108 are provided with the LED heads 109, 110, 111 and 112 for forming static latent images on charged surfaces of the photosensitive members through irradiating light with an exposure unit such as an LED; and toner cartridge memories 131, 132, 133 and 134 for storing color information and a remaining amount of toner retained in the toner cartridge.

As shown in FIG. 2, the control circuit board 140 is disposed at an upper portion or a side portion of the housing 101. The printer 1 is connected to a host computer (a host personal computer or a host PC) through the external interface unit 122 or an LAN (Local Area Network). The control circuit board 140 includes an input output unit for transmitting and receiving print data between the printer 1 and the host PC, and for a user to set a mode and the like through a display on the operation panel 121; the control unit for controlling an entire portion of the printer 1 to operate each component of the printer 1 and process the print data; and a memory such as an EEPROM 141 for storing a necessary program for operating the printer 1 and the print data. The input output unit, the control unit, and the EEPROM 141 are integrated as the integrated circuit.

As shown in FIG. 2, the operation panel 121 as the input output unit is disposed on the upper front surface of the housing 101 of the printer 1, and is connected to an operation panel control unit 201 of the control circuit board 140 (described later). The user operates a keyboard according to a screen displayed on a display portion formed of a liquid crystal display, so that the user can set the mode or make a selection.

Figure 3:
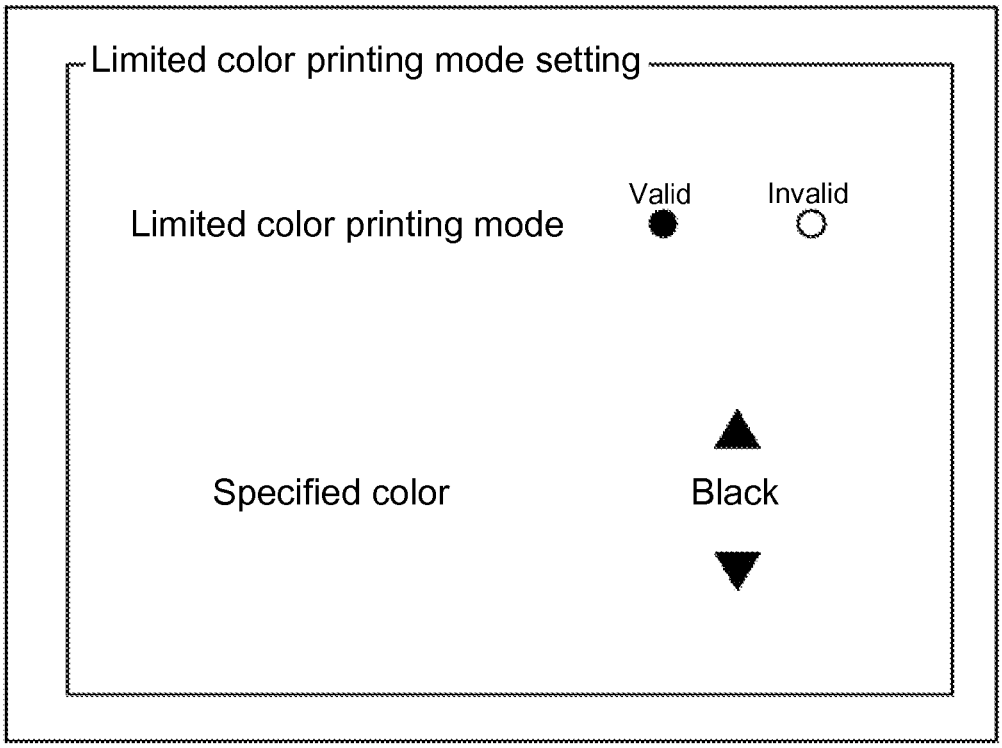
FIG. 3 is a schematic view showing an example of an operation panel of the image forming apparatus according to the first embodiment of the present invention.
Figure 4:
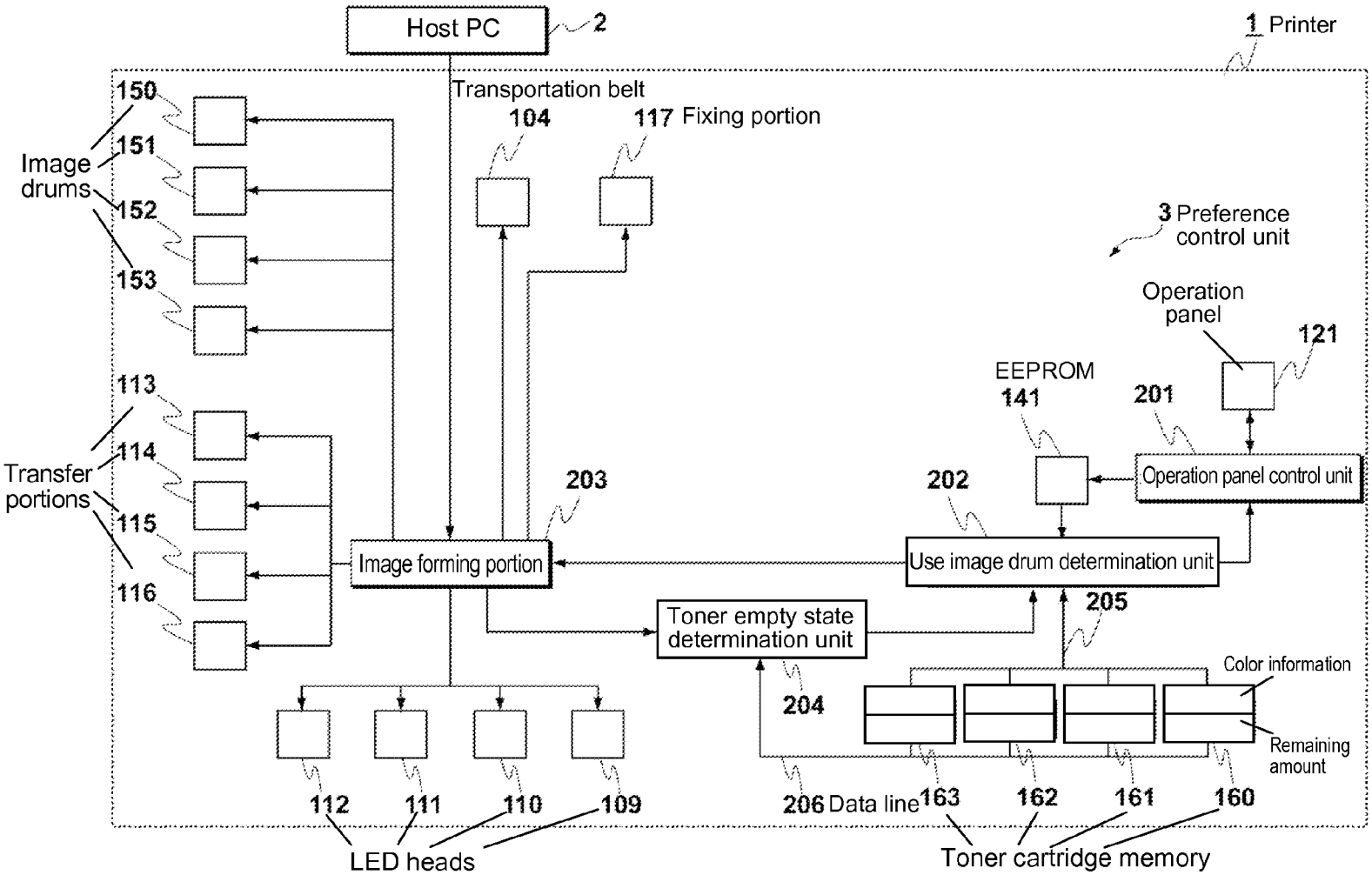
FIG. 4 is a block diagram showing the configuration of the preference control unit of the image forming apparatus in a color printing operation thereof according to the first embodiment of the present invention.

FIG. 3 is a schematic view showing an example of the operation panel 121 of the image forming apparatus according to the first embodiment of the present invention. As shown in FIG. 3, the user can set the mode between a limited color printing mode and a multiple color printing mode. When the user selects the limited color printing mode, a valid light is turned on, thereby storing color information specifying a single color as a specified color in the EEPROM 141. When the user selects the multiple color printing mode, an invalid light of the limited color printing mode is turned on, thereby storing the color information specifying a plurality of colors as the specified color in the EEPROM 141. When the user specifies a certain color as the single color, the user operates the keyboard to store the certain color in the EEPROM 141, and the certain color is displayed on the display portion.

Figure 1:
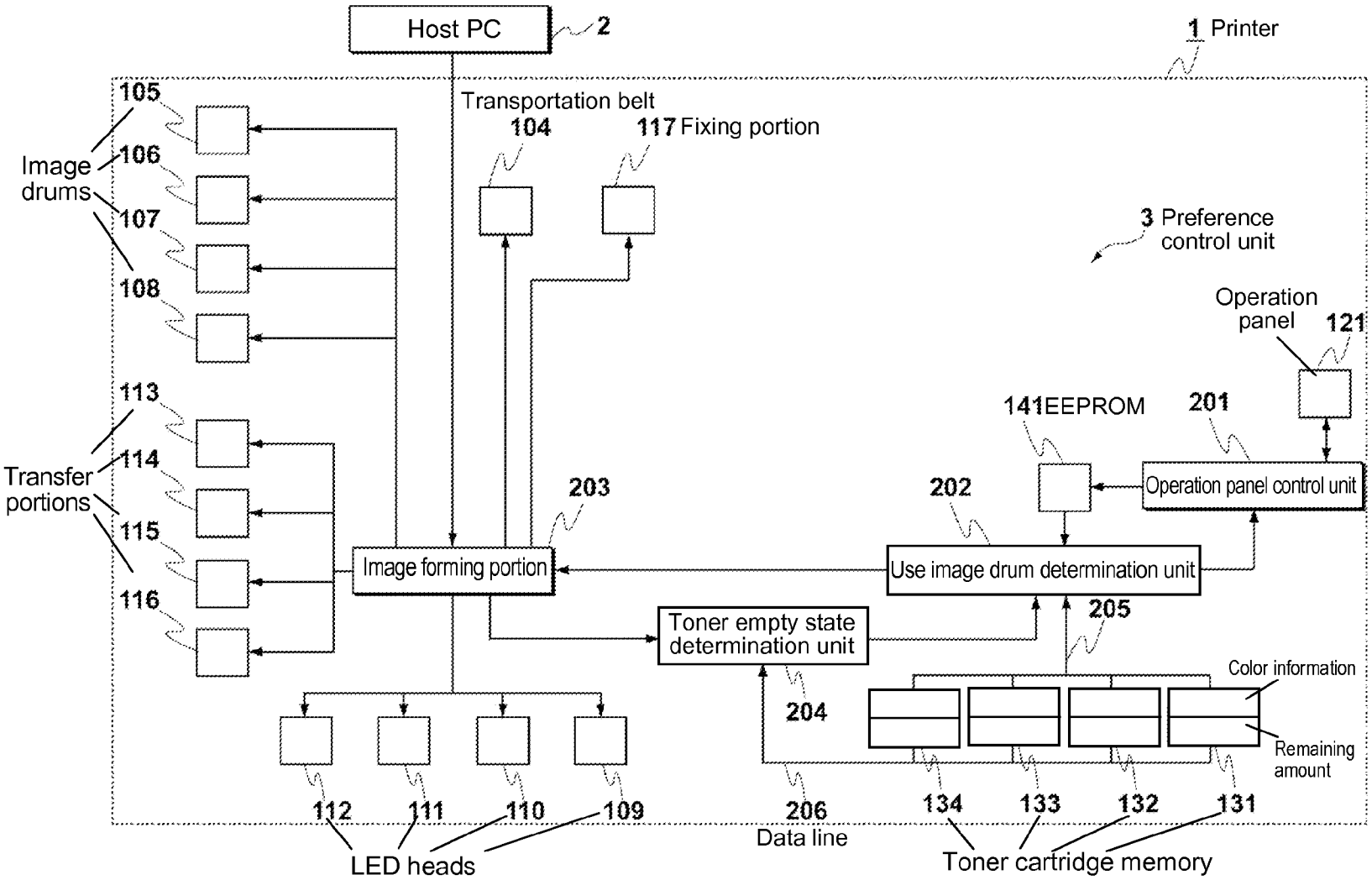
FIG. 1 is a block diagram showing a configuration of a preference control unit of an image forming apparatus according to a first embodiment of the present invention.

A preference control unit 3 of the printer 1 will be explained next. FIG. 1 is a block diagram showing a configuration of the preference control unit 3 of the printer 1 according to the first embodiment of the present invention.

As shown in FIG. 1, the preference control unit 3 includes an operation panel control unit 201 for controlling the operation panel 121 as the input output unit; the EEPROM 141 for storing the specified color information according to the operation of the operation panel 121; a use image drum determination unit 202 for determining an image drum to be used among the image drums 105, 106, 107 and 108 according to the specified color information retrieved from the EEPROM 141, and the color information of toner and the toner remaining amount information retrieved from the toner cartridge memories 131, 132, 133 and 134; a toner empty state determination unit 204 for determining whether the toner cartridge retains toner or is empty; and the image forming portion 203 for receiving the print data and a control demand from the host PC 2 as the upper device, and for controlling the LED heads 109, 110, 111 and 112, the transfer portions 113, 114, 115 and 116, the transportation belt 104, and the fixing portion 117.

In the embodiment, the use image drum determination unit 202 is provided for determining which one of the image drums 105, 106, 107 and 108 is installed at which position, so that the use image drum determination unit 202 determines the image drum to be used according to the color information stored in the toner cartridge memories 131, 132, 133 and 134. The use image drum determination unit 202 includes a control circuit having an information processing function such as a microprocessor and a volatile memory such as an SRAM.

More specifically, the use image drum determination unit 202 is arranged to determine whether the color information is retrieved from the toner cartridge memories 131, 132, 133 and 134 in the image drums 105, 106, 107 and 108 according to the program stored in the EEPROM 141. When the use image drum determination unit 202 determines that the color information is not retrieved, the use image drum determination unit 202 retrieves the color information from the toner cartridge memories 131, 132, 133 and 134 through a data line 205. It is noted that the use image drum determination unit 202 registers the color information the toner cartridge memories 131, 132, 133 and 134 based on a bar code that can be identified according to toner colors of the image drums 105, 106, 107 and 108 or the toner cartridges.

When the use image drum determination unit 202 determines that the color information is retrieved, the use image drum determination unit 202 is capable of determining which one of the image drums 105, 106, 107 and 108 is installed at which position. Accordingly, the use image drum determination unit 202 has a function of determining the image drum to be used among the image drums 105, 106, 107 and 108 according to the specified color information retrieved from the EEPROM 141 and the color information retrieved from the toner cartridge memories 131, 132, 133 and 134. When there is only one image drum of the specified color among the image drums 105, 106, 107 and 108, the use image drum determination unit 202 determines the one image drum as a consumed image drum, and stores information of the one image drum among the image drums 105, 106, 107 and 108 in the SRAM in the use image drum determination unit 202.

When there is a plurality of image drums of the specified color among the image drums 105, 106, 107 and 108, the use image drum determination unit 202 determines the image drum to be used through the following process. For example, it is supposed that the specified color information is black (K) color. In this case, the use image drum determination unit 202 searches the image drums 106, 107 and 108 of black (K) installed at a position where the image drum of black (K) is not normally installed. It is supposed that the image drums 106, 107 and 108 of black (K) are installed at positions where the image drums of other colors are normally installed. Accordingly, the use image drum determination unit 202 detects the image drums 106, 107 and 108.

In the next step, the use image drum determination unit 202 determines whether the image drums 106, 107 and 108 are empty according to toner empty information notified from the toner empty state determination unit 204. When the use image drum determination unit 202 determines that the image drums 106, 107 and 108 are not empty, the use image drum determination unit 202 determines the image drums 106, 107 and 108 as a candidate for the image drum to be used.

In the embodiment, a remaining amount sensor is disposed on a stirring bar (not shown) arranged in each of the toner cartridges for determining whether the image drums 106, 107 and 108 are empty. More specifically, the remaining amount sensor detects the remaining amount of toner in each of the toner cartridges, and registers the remaining amount in the toner cartridge memories 131, 132, 133 and 134 all the time. When the image drums 106, 107 and 108 become the empty state, the empty state is displayed on the operation panel 121, so that the user is alarmed.

In the next step, in order to determine the image drum to be used from the candidates, the use image drum determination unit 202 determines which image drum retains toner in the specified color in an order of the image drum 106 installed at a position where the image drum of yellow is normally installed, the image drum 107 installed at a position where the image drum of magenta is normally installed, and the image drum 108 installed at a position where the image drum of cyan is normally installed.

In the embodiment, a detection unit such as a bar code reader is provided for detecting a bar code of the image drum or the toner cartridge, so that the use image drum determination unit 202 determines which image drum retains toner in the specified color. It is supposed that the image drum 106 installed at the position where the image drum of yellow is normally installed retains toner of black (K). Accordingly, the use image drum determination unit 202 determines the image drum 106 as the consumed image drum, and registers the information in the SRAM in the use image drum determination unit 202. As a result, the image drum 105, i.e., the original image drum of black (K), is left unused.

In the embodiment, the toner empty state determination unit 204 is provided for detecting the remaining amount of toner in each of the toner cartridges with the remaining amount sensor, so that the toner empty state determination unit 204 determines whether each of the toner cartridges is empty. The toner empty state determination unit 204 includes a control circuit having an information processing function such as a microprocessor.

More specifically, when the printer 1 is turned on, at which the image drums 105, 106, 107 and 108 are likely replaced, or when a housing cover is opened, the toner empty state determination unit 204 is arranged to retrieve the remaining amount of toner from the toner cartridge memories 131, 132, 133 and 134 in the image drums 105, 106, 107 and 108 through a data line 206 according to the program stored in the EEPROM 141. Accordingly, the toner empty state determination unit 204 determines whether each of the toner cartridges is empty, and transmits the toner empty information to the use image drum determination unit 202.

Further, every time when the printer 1 prints one page, the image forming portion 203 transmits a consumed amount of toner to the toner empty state determination unit 204. Accordingly, the toner empty state determination unit 204 determines whether each of the toner cartridges is empty, and transmits the toner empty information to the use image drum determination unit 202.

In the embodiment, when the image forming portion 203 receives the print data from the host PC 2, the image forming portion 203 heats the fixing portion 117, and controls the transportation belt 104 to transport the printing medium 103. When the printing medium 103 is transported, the image forming portion 203 uses the image drums 105, 106, 107 and 108 in the single color to form a toner layer in the single color on the photosensitive members through an electro-photography process.

More specifically, the image forming portion 203 retrieves the use drum information from the SRAM in the use image drum determination unit 202. Then, the image forming portion 203 uses the specified one of the LED heads 109, 110, 111 and 112 paired with the image drums 105, 106, 107 and 108 to expose the photosensitive member, thereby forming the static latent image in black (K). Then, the image forming portion 203 uses the specified one of the image drums 105, 106, 107 and 108 to attach toner in black (K) to the surface of the photosensitive member, thereby developing the static latent image. Further, the image forming portion 203 uses the specified one of the transfer portions 113, 114, 115 and 116 to transfer the toner image formed on the photosensitive member to the printing medium 103 supplied from the tray 102. Accordingly, the toner image in black (K) is formed on the printing medium 103. Afterward, the fixing portion 117 heats and presses the toner image transferred to the printing medium 103, thereby fixing the toner image to the printing medium 103.

In the embodiment, when the printer 1 is used as the multiple color (color) printer, the user selects the multiple color printing mode (invalidates the limited color printing mode) through the operation panel 121 shown in FIG. 3. Accordingly, the operation panel control unit 201 sets the specified color information as no specified color, and registers the specific color information in the EEPROM 141. When the use image drum determination unit 202 receives the specified color information as no specified color, the use image drum determination unit 202 registered data with no specified color in the SRAM in the use image drum determination unit 202.

Figure 5:
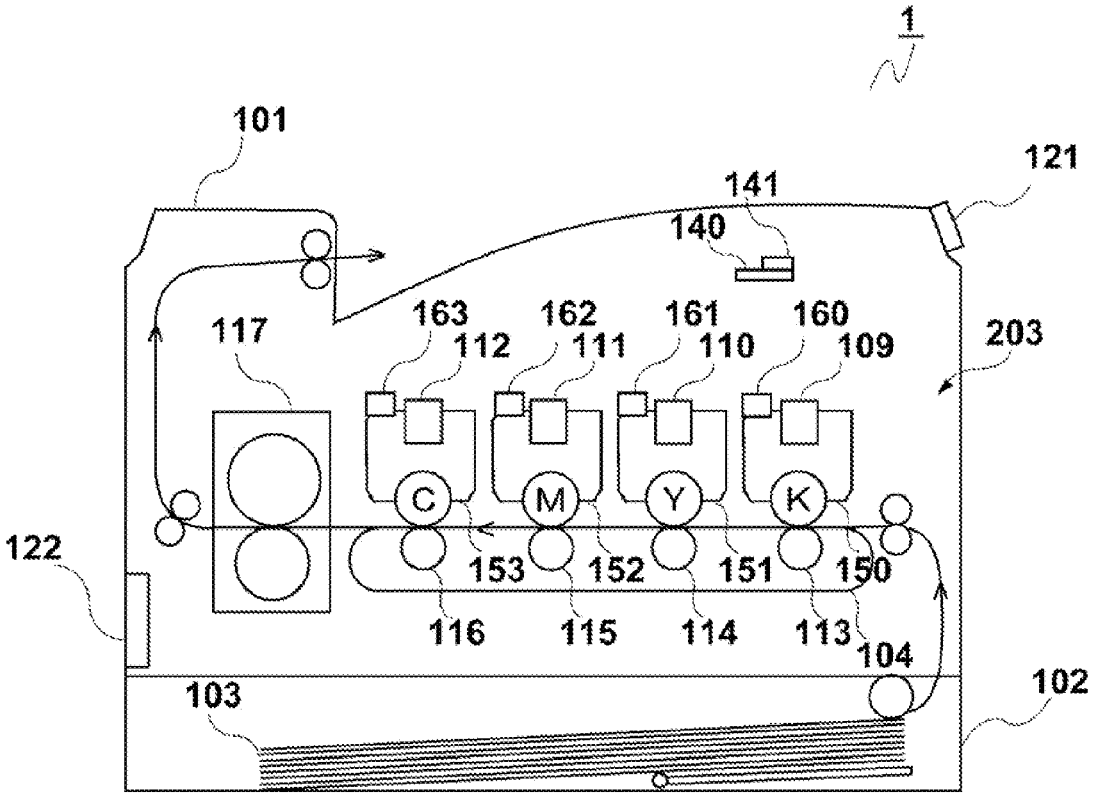
FIG. 5 is a schematic sectional view showing the configuration of the image forming apparatus applied to the printer in the color printing operation thereof according to the first embodiment of the present invention.

FIG. 5 is a schematic sectional view showing the configuration of the image forming apparatus applied to the printer 1 in the color printing operation thereof according to the first embodiment of the present invention. As shown in FIG. 5, when the image forming portion 203 receives the print data from the host PC 2, the image forming portion 203 heats the fixing portion 117, and controls the transportation belt 104 to transport the printing medium 103. When the printing medium 103 is transported, the image forming portion 203 uses image drums 150, 151, 152 and 153 in each color of cyan (C), magenta (M), yellow (Y), and black (K) to form the toner layer in each color on the photosensitive members through the electro-photography process.

More specifically, the image forming portion 203 retrieves the use drum information from the SRAM in the use image drum determination unit 202. Since there is no specified color, the image forming portion 203 uses the LED heads 109, 110, 111 and 112 to expose the photosensitive members, thereby forming the static latent images in multiple colors according to the color information of the print data. Then, the image forming portion 203 uses the transfer portions 113, 114, 115 and 116 to transfer the toner images formed on the photosensitive members to the printing medium 103 supplied from the tray 102. Accordingly, the toner images in multiple colors are formed on the printing medium 103. Afterward, the fixing portion 117 heats and presses the toner images transferred to the printing medium 103, thereby fixing the toner images to the printing medium 103.

Figure 6:
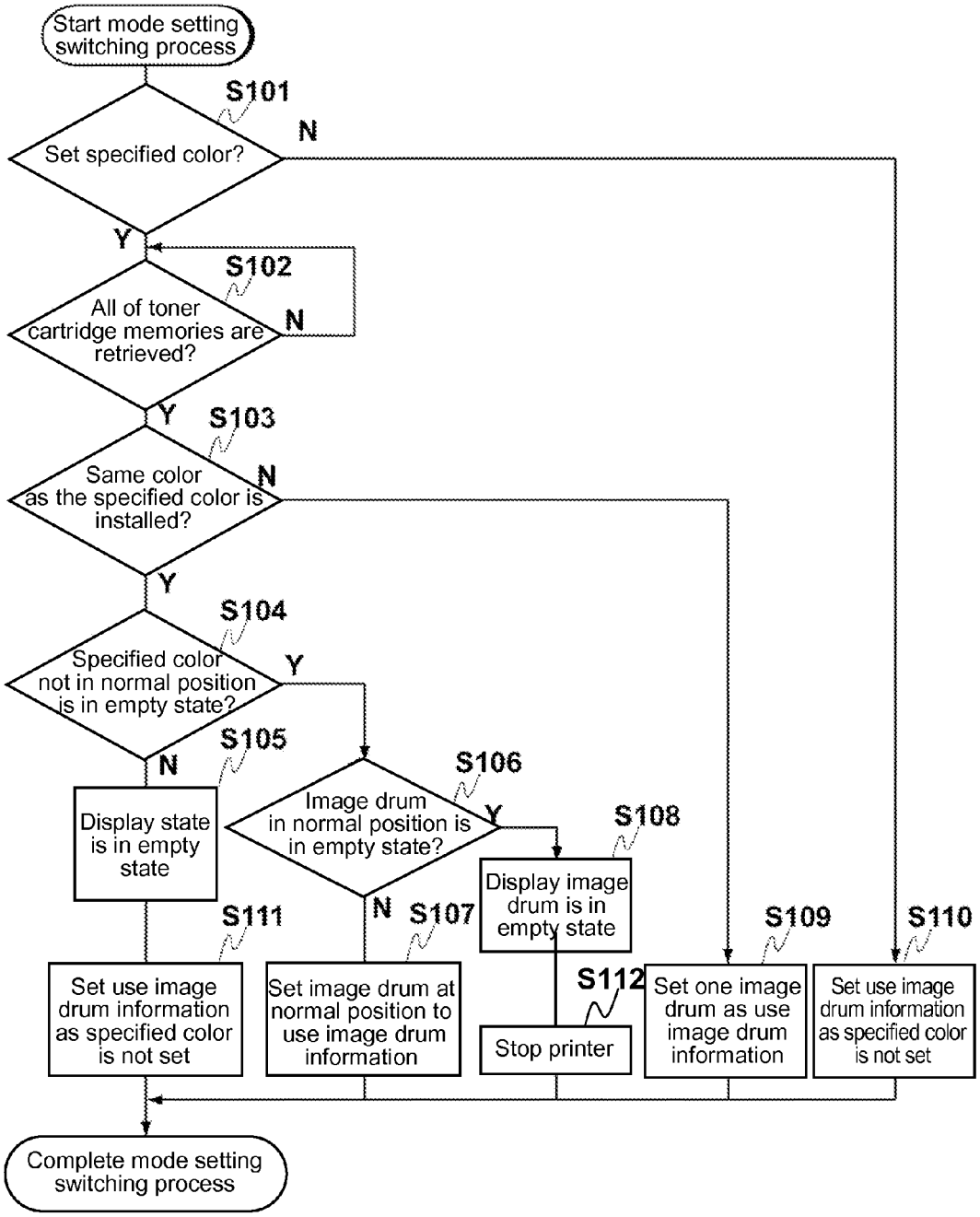
FIG. 6 is a flow chart showing an operation of the image forming apparatus in a mode setting switching process thereof according to the first embodiment of the present invention.
Figure 7:
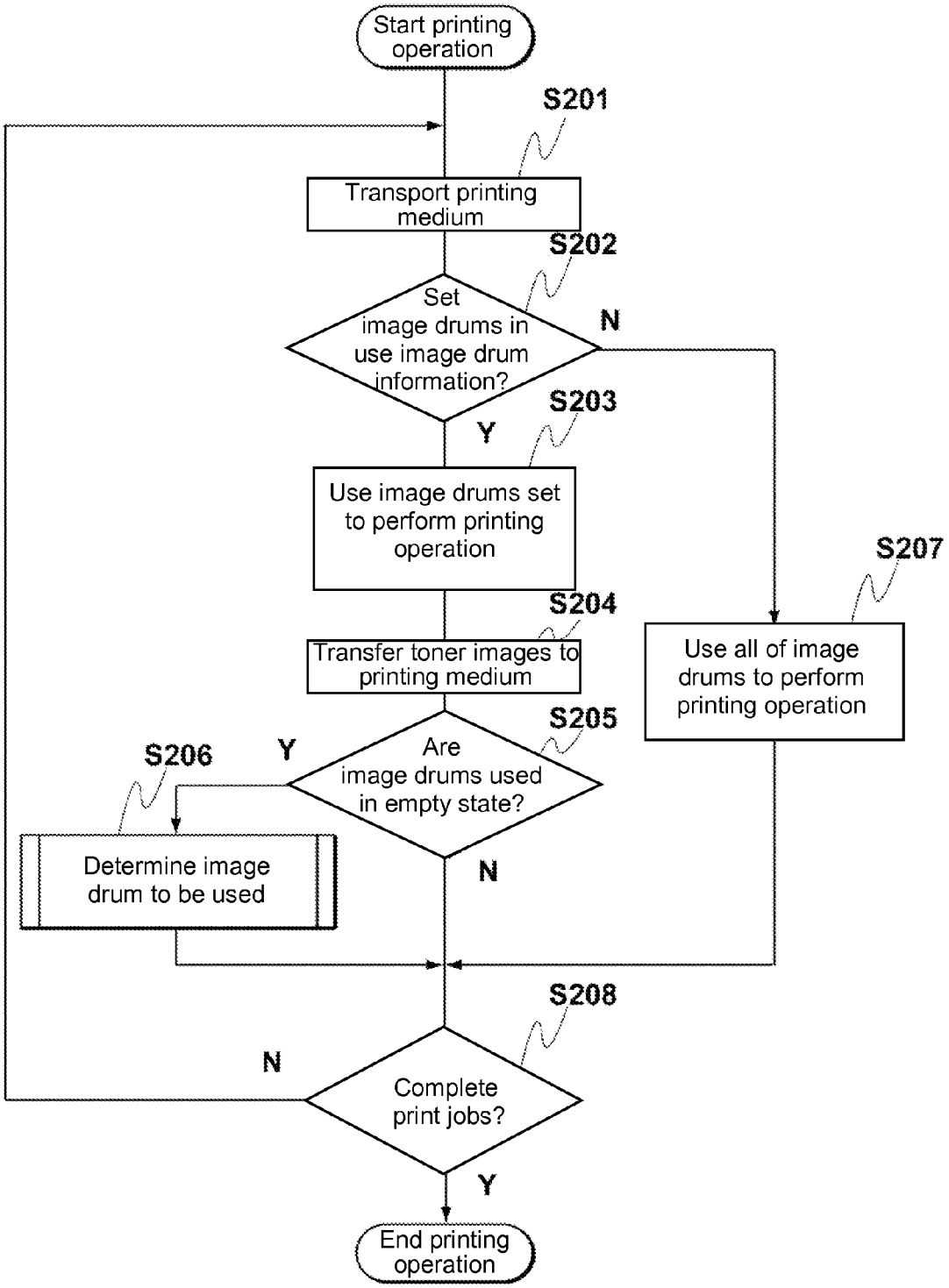
FIG. 7 is a flow chart showing an operation of the image forming apparatus in a printing operation thereof according to the first embodiment of the present invention.

An operation of the printer 1 in an image drum selection process will be explained next with reference to flow charts. FIG. 6 is a flow chart showing the operation of the image forming apparatus in a mode setting switching process thereof according to the first embodiment of the present invention. FIG. 7 is a flow chart showing the operation of the image forming apparatus in a printing operation thereof after the printer 1 receives the print data from the host PC 2 according to the first embodiment of the present invention.

After the mode setting switching process stars, when the user switches the setting of the printing mode through the operation panel 121, the specified color information is stored in the EEPROM 141. Then, the use image drum determination unit 202 retrieves the specified color information from the EEPROM 141. In step S101, the use image drum determination unit 202 determines whether the specified color is set from the toner cartridge memories 131, 132, 133 and 134. In step S110, when the use image drum determination unit 202 determines that the specified color is not set, the use image drum determination unit 202 sets the use image drum information as that the specified color is not set, thereby completing the process. When the use image drum determination unit 202 determines that the specified color is set, the use image drum determination unit 202 proceeds the process to step S102.

In step S102, the use image drum determination unit 202 determines whether all of the toner cartridge memories 131, 132, 133 and 134 are retrieved. When the use image drum determination unit 202 determines that all of the toner cartridge memories 131, 132, 133 and 134 are not retrieved, the use image drum determination unit 202 waits until all of the toner cartridge memories 131, 132, 133 and 134 are retrieved.

In step S103, when all of the toner cartridge memories 131, 132, 133 and 134 are retrieved, the use image drum determination unit 202 determines whether a plurality of the image drums 106, 107 and 108 in the color same as the specified color is installed according to the color information retrieved from the toner cartridge memories 131, 132, 133 and 134. In step S109, when the use image drum determination unit 202 determines that only one of the image drums 106, 107 and 108 is installed, the use image drum determination unit 202 sets the one of the image drums 106, 107 and 108 as the use image drum information.

In step S104, when the use image drum determination unit 202 determines that a plurality of the image drums 106, 107 and 108 is installed, the use image drum determination unit 202 determines whether all of the image drums 106, 107 and 108 in the color same as the specified color and installed at positions other than the positions where the image drums 106, 107 and 108 are normally installed in the color printing operation are in the empty state.

In step S105, when the use image drum determination unit 202 determines in step S104 that not all of the image drums 106, 107 and 108 in the color same as the specified color and installed at positions other than the positions where the image drums 106, 107 and 108 are normally installed in the color printing operation are in the empty state, the use image drum determination unit 202 displays the state that at least one of the image drums 106, 107 and 108 is in the empty state on the operation panel 121. In step S111, the use image drum determination unit 202 sets the use image drum information, in which the image drum 106 not in the empty state and installed at a most upstream position among the image drums not in the empty state as the highest position in the preference order. Then, the use image drum determination unit 202 sets the use image drum information, in which the image drums 107 and 108 installed at downstream positions as the subsequent positions in the preference order.

In step S106, when the use image drum determination unit 202 determines in step S104 that all of the image drums 106, 107 and installed at positions other than the positions where the image drums 106, 107 and 108 are normally installed in the color printing operation are in the empty state, the use image drum determination unit 202 determines whether the image drum 105 installed at the normal position is in the empty state.

In step S107, the use image drum determination unit 202 determines in step S106 that the image drum 105 installed at the normal position is not in the empty state, the use image drum determination unit 202 sets the image drum 105 installed at the normal position to the use image drum information, thereby completing the process.

In step S108, when the use image drum determination unit 202 determines in step S106 that the image drum 105 installed at the normal position is in the empty state, the use image drum determination unit 202 controls the operation panel 121 through the operation panel control unit 201 to display that the image drum 105 is in the empty state. In step S112, the use image drum determination unit 202 stops the printer 1, thereby completing the process.

The printing operation of the printer 1 will be explained next with reference to the flow chart shown in FIG. 7. In step S201, when the user operates the host PC to start the printing operation, the image forming portion 203 starts the transportation belt 104 to transport the printing medium 103 from the tray 102 according to the print data.

In step S202, the image forming portion 203 retrieves the use image drum information from the SRAM in the use image drum determination unit 202, so that the image forming portion 203 determines whether the image drums 105, 106, 107 and 108 are set in the use image drum information. In step S207, when the image forming portion 203 determines that the image drums 105, 106, 107 and 108 are not set in the use image drum information, the image forming portion 203 uses all of the image drums 105, 106, 107 and 108 to perform the printing operation.

In step S203, when the image forming portion 203 determines that the image drums 106, 107 and 108 are set in the use image drum information, the image forming portion 203 uses the image drums 106, 107 and 108 and the LED heads 110, 111 and 112 paired with the image drums 106, 107 and 108 to perform the printing operation.

In step S204, the image forming portion 203 uses the transfer portions 114, 115 and 116 to transfer the toner images to the printing medium 103. In step S205, the use image drum determination unit 202 determines whether the image drums 106, 107 and 108 thus used are in the empty state.

In step S206, when the use image drum determination unit 202 determines that the image drums 106, 107 and 108 thus used are in the empty state, the use image drum determination unit 202 performs the process shown in FIG. 6 to determine the image drum to be used. When the use image drum determination unit 202 determines that the image drums 106, 107 and 108 thus used are not in the empty state, the use image drum determination unit 202 does not determine the image drum to be used.

In step S208, the image forming portion 203 determines whether the print jobs are completed. When the image forming portion 203 determines that the print jobs are completed, the image forming portion 203 stops the printing operation. When the image forming portion 203 determines that the print jobs are not completed, the image forming portion 203 repeats the process described above until the print jobs are completed.

As explained above, in the embodiment, the image drum 105 in black (K) is not used until the last step. Accordingly, toner of the image drum 105 in black (K), which is used in the monochrome printing operation, is not consumed and left unused.

Second Embodiment

A second embodiment of the present invention will be explained next. Components in the second embodiment similar to those in the first embodiment are designated with the same reference numerals, and explanations thereof are omitted. In the second embodiment, similar to the first embodiment, the image forming apparatus is applied to the printer 1.

Figure 10:
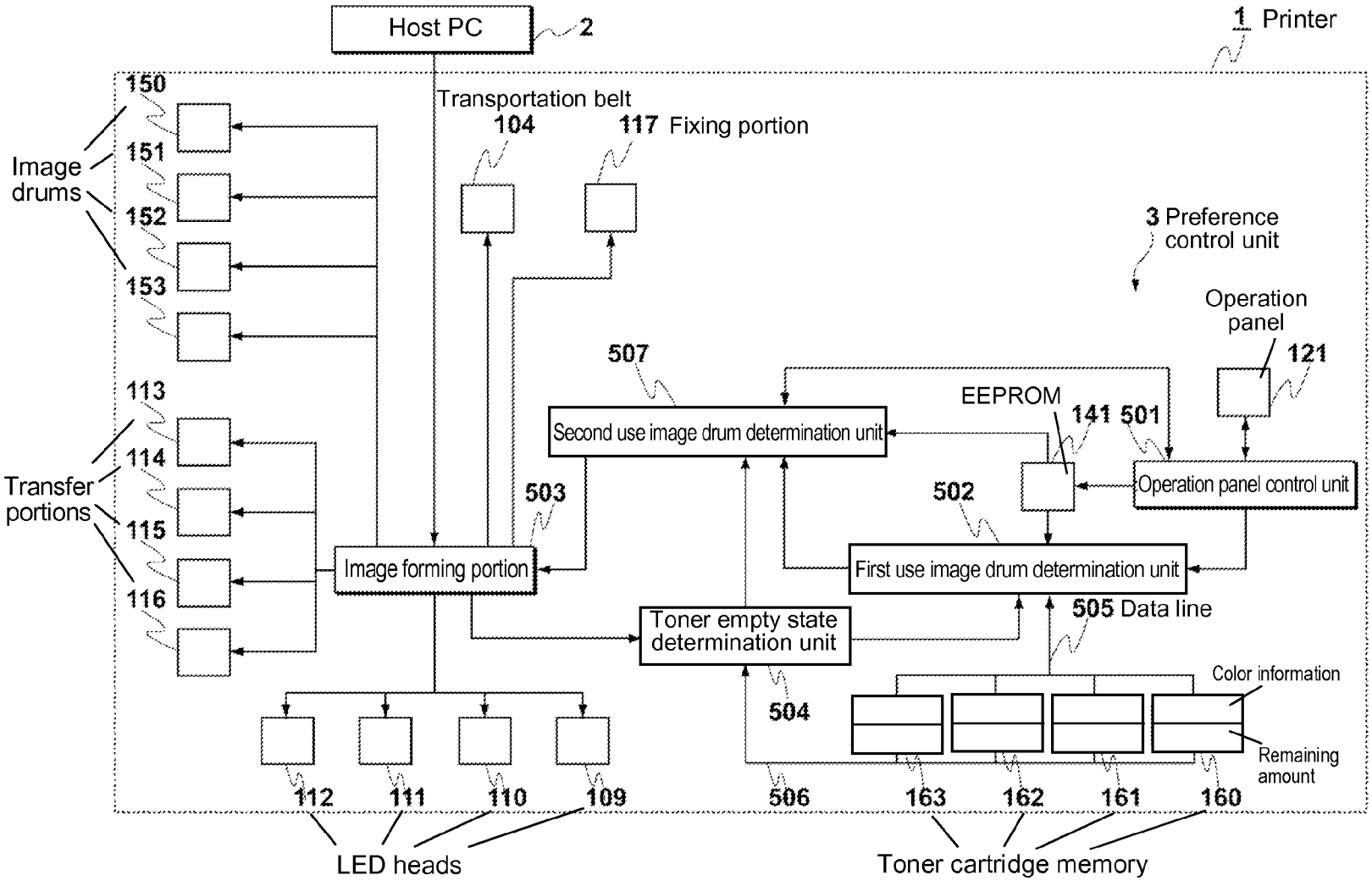
FIG. 10 is a block diagram showing the configuration of the preference control unit of the image forming apparatus in a color printing operation thereof according to the second embodiment of the present invention.

In the second embodiment, similar to the printer 1 in the first embodiment shown in FIG. 2, the printer 1 includes the housing 101 and an image forming portion 503 disposed in the housing 101 (refer to FIG. 10). The image forming portion 503 includes the image drums 105, 106, 107 and 108 (image forming units) for different colors such as cyan (C), magenta (M), yellow (Y) and black (K); the LED (Light Emitting Diode) heads 109, 110, 111 and 112 disposed for each of the image drums 105, 106, 107 and 108 for exposure; the transfer portions 113, 114, 115 and 116 for transferring the developed images to the printing medium 103; and the transportation belt 104.

In the embodiment, the image forming portion 503 further includes the fixing portion 117 for fixing toner transferred to the printing medium 103; the control circuit board 140 disposed above the image drums 105, 106, 107 and 108; the operation panel 121 disposed on the upper front surface of the housing 101 near the control circuit board 140; and the external interface unit 122 (an I/F) disposed on the lower backside surface of the housing 101 for externally connecting to an external device. Further, the printer 1 includes the tray 102 disposed below the image forming portion 503 for storing the printing medium 103.

In the embodiment, each of the image drums 105, 106, 107 and 108 includes the photosensitive member (not shown); the charging roller (not shown) disposed around the outer circumferential surface of the photosensitive member for uniformly charging the photosensitive member; the developing roller (not shown) for coating toner on the surface of the photosensitive member thus charged; the developing blade (not shown); the toner supply sponge roller (not shown); the cleaning blade (not shown) for removing toner on the photosensitive member after transfer; and the toner cartridge for retaining toner. The toner cartridge is configured to be detachable relative to each of the image drums 105, 106, 107 and 108, and may be integrated with the image drums 105, 106, 107 and 108.

In the embodiment, the image drums 105, 106, 107 and 108 are provided with the LED heads 109, 110, 111 and 112 for forming the static latent images on the charged surfaces of the photosensitive members through irradiating light with the exposure unit such as the LED; and the toner cartridge memories 131, 132, 133 and 134 for storing the color information and the remaining amount of toner retained in the toner cartridge.

As shown in FIG. 2, the control circuit board 140 is disposed at the upper portion or the side portion of the housing 101. The printer 1 is connected to the host computer (the host personal computer or the host PC) through the external interface unit 122 or the LAN (Local Area Network). The control circuit board 140 includes the input output unit for transmitting and receiving the print data between the printer 1 and the host PC, and for the user to set the mode and the like through the display on the operation panel 121; the control unit for controlling the entire portion of the printer 1 to operate each component of the printer 1 and process the print data; and the memory such as the EEPROM 141 for storing the necessary program for operating the printer 1 and the print data. The input output unit, the control unit, and the EEPROM 141 are integrated as the integrated circuit.

In the embodiment, the operation panel 121 is connected to the control unit of the control circuit board 140. The user operates the keyboard according to the screen displayed on the display portion formed of the liquid crystal display, so that the user can set the mode or make the selection.

Figure 8:
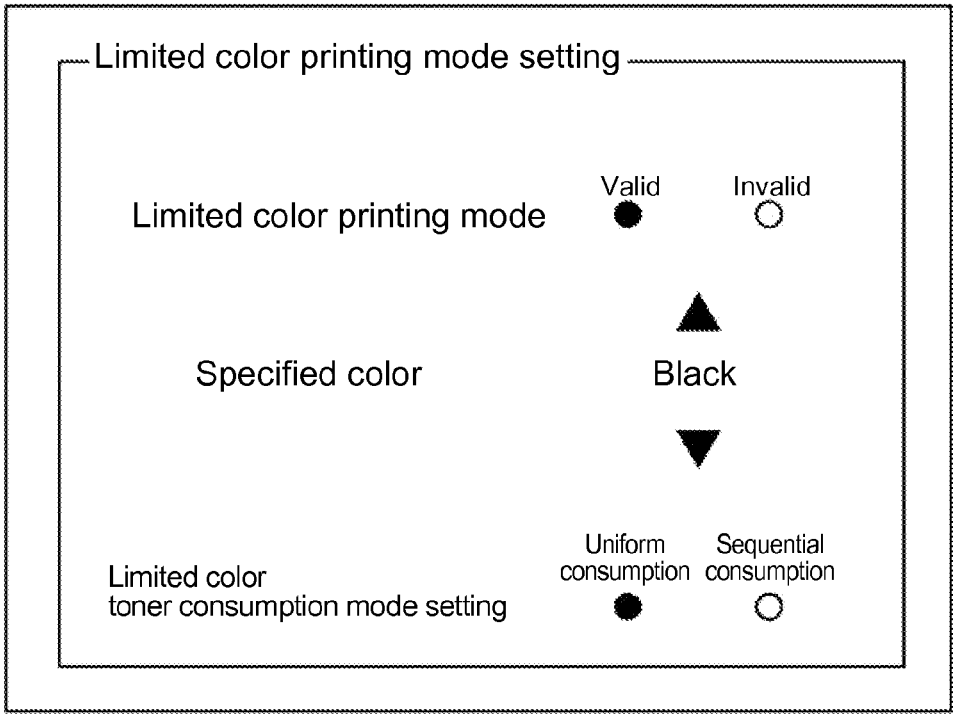
FIG. 8 is a schematic view showing an example of an operation panel of an image forming apparatus according to a second embodiment of the present invention.

FIG. 8 is a schematic view showing an example of the operation panel 121 of the image forming apparatus according to the second embodiment of the present invention. As shown in FIG. 8, the user can set the mode between the limited color printing mode and the multiple color printing mode. When the user selects the limited color printing mode, a valid light is turned on, thereby storing the color information specifying the single color as the specified color in the EEPROM 141. When the user selects the multiple color printing mode, an invalid light of the limited color printing mode is turned on, thereby storing the color information specifying a plurality of colors as the specified color in the EEPROM 141. When the user specifies a certain color as the single color, the user operates the keyboard to store the certain color in the EEPROM 141, and the certain color is displayed on the display portion.

In the embodiment, the user can selects an order of using the toner cartridges through a limited color toner consumption mode setting. When the user selects a uniform consumption, the toner cartridge remaining toner in a largest amount is used, so that all of the toner cartridges become the empty state at the same time. When the user selects a sequential consumption, the toner cartridge is completely used one by one. Each time when the toner cartridge becomes the empty state, a warning is displayed on the panel.

Figure 9:
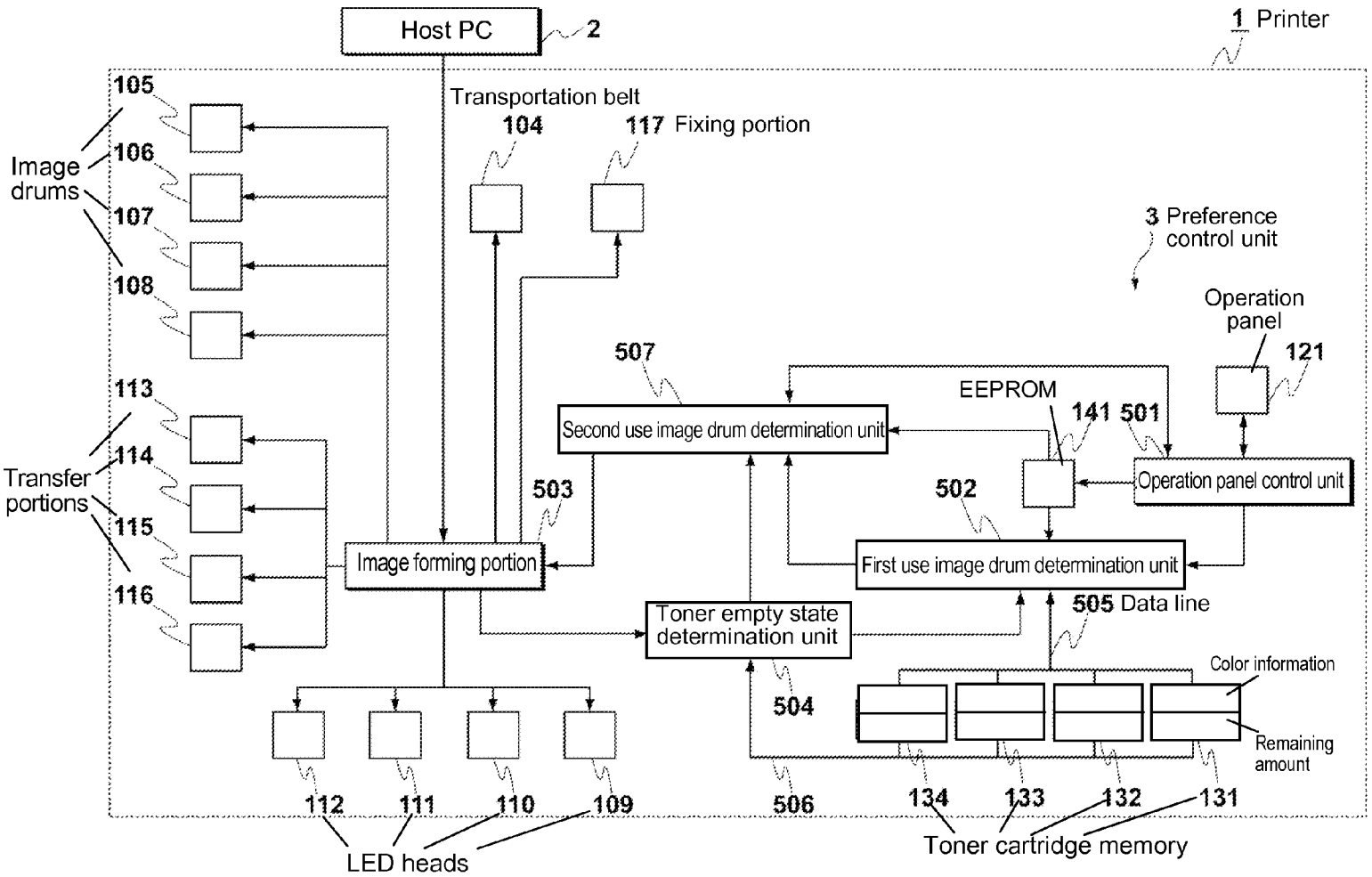
FIG. 9 is a block diagram showing a configuration of a preference control unit of the image forming apparatus according to the second embodiment of the present invention.

The preference control unit 3 of the printer 1 in the second embodiment will be explained next. FIG. 9 is a block diagram showing a configuration of the preference control unit 3 of the printer 1 according to the second embodiment of the present invention.

As shown in FIG. 9, the preference control unit 3 of the printer 1 includes an operation panel control unit 501 for controlling the operation panel 121 as the input output unit; the EEPROM 141 for storing the specified color information according to the operation of the operation panel 121; a first use image drum determination unit 502 for determining an image drum to be used among the image drums 105, 106, 107 and 108 according to the specified color information retrieved from the EEPROM 141, and the color information of toner and the toner remaining amount information retrieved from the toner cartridge memories 131, 132, 133 and 134; a toner empty state determination unit 504 for determining whether the toner cartridge retains toner or is empty; and the image forming portion 503 for receiving the print data and the control demand from the host PC 2 as the upper device, and for controlling the LED heads 109, 110, 111 and 112, the image drums 105, 106, 107 and 108, the transfer portions 113, 114, 115 and 116, and the fixing portion 117, and a second use image drum determination unit 507.

In the embodiment, the first use image drum determination unit 502 is provided for determining which one of the image drums 105, 106, 107 and 108 is installed at which position, so that the first use image drum determination unit 502 determines the image drum to be used according to the color information stored in the toner cartridge memories 131, 132, 133 and 134. The use image drum determination unit 502 includes a control circuit having an information processing function such as a microprocessor and a volatile memory such as an SRAM.

More specifically, the first use image drum determination unit 502 is arranged to determine whether the color information is retrieved from the toner cartridge memories 131, 132, 133 and 134 in the image drums 105, 106, 107 and 108 according to the program stored in the EEPROM 141. When the first use image drum determination unit 502 determines that the color information is not retrieved, the first use image drum determination unit 502 retrieves the color information from the toner cartridge memories 131, 132, 133 and 134 through a data line 505.

When the first use image drum determination unit 502 determines that the color information is retrieved, the use image drum determination unit 202 is capable of determining which one of the image drums 105, 106, 107 and 108 is installed at which position. Accordingly, the first use image drum determination unit 502 has a function of determining the image drum to be used among the image drums 105, 106, 107 and 108 according to the specified color information retrieved from the EEPROM 141 and the color information retrieved from the toner cartridge memories 131, 132, 133 and 134.

When there is only one image drum of the specified color among the image drums 105, 106, 107 and 108, the first use image drum determination unit 502 determines the one image drum as a consumed image drum, and stores information of the one image drum among the image drums 105, 106, 107 and 108 in the SRAM in the first use image drum determination unit 502.

When there is a plurality of image drums of the specified color among the image drums 105, 106, 107 and 108, the first use image drum determination unit 502 determines the image drum to be used through the following process. For example, it is supposed that the specified color information is black (K) color. In this case, the first use image drum determination unit 502 searches the image drums 106, 107 and 108 of black (K) installed at a position where the image drum of black (K) is not normally installed. It is supposed that the image drums 106, 107 and 108 of black (K) are installed at positions where the image drums of other colors are normally installed. Accordingly, the first use image drum determination unit 502 detects the image drums 106, 107 and 108.

In the next step, the first use image drum determination unit 502 determines whether the image drums 106, 107 and 108 are empty according to toner empty information notified from the toner empty state determination unit 504. When the first use image drum determination unit 502 determines that the image drums 106, 107 and 108 are not empty, the first use image drum determination unit 502 determines the image drums 106, 107 and 108 as a candidate for the image drum to be used.

In the embodiment, a remaining amount sensor is disposed on a stirring bar (not shown) arranged in each of the toner cartridges for determining whether the image drums 106, 107 and 108 are empty. More specifically, the remaining amount sensor detects the remaining amount of toner in each of the toner cartridges, and registers the remaining amount in the toner cartridge memories 131, 132, 133 and 134 all the time. When the image drums 106, 107 and 108 become the empty state, the empty state is displayed on the operation panel 121, so that the user is alarmed.

In the next step, in order to determine the image drum to be used from the candidates, the use image drum determination unit 202 determines which image drum retains toner in the specified color in an order of the image drum 106 installed at a position where the image drum of yellow is normally installed, the image drum 107 installed at a position where the image drum of magenta is normally installed, and the image drum 108 installed at a position where the image drum of cyan is normally installed.

In the embodiment, a detection unit such as a bar code reader is provided for detecting a bar code of the image drum or the toner cartridge, so that the first use image drum determination unit 502 determines which image drum retains toner in the specified color. It is supposed that the image drum 106 installed at the position where the image drum of yellow is normally installed retains toner of black (K). Accordingly, the first use image drum determination unit 502 determines the image drum 106 as the consumed image drum, and registers the information in the SRAM in the first use image drum determination unit 502. As a result, the image drum 105, i.e., the original image drum of black (K), is left unused.

In the embodiment, the second use image drum determination unit 507 includes a control circuit having an information processing function such as a microprocessor and a volatile memory such as an SRAM. The second use image drum determination unit 507 is provided for determining a method of using toner. More specifically, the second use image drum determination unit 507 is provided for selecting a sequential consumption mode or a uniform consumption mode. In the sequential consumption mode, toner in a plurality of the toner cartridges is consumed sequentially for each of the toner cartridges. In the uniform consumption mode, toner in a plurality of the toner cartridges is consumed uniformly.

More specifically, in the sequential consumption mode, similar to the first embodiment, the second use image drum determination unit 507 is arranged to determine which image drum retains toner in the specified color in the order of the image drum 106 installed at the position where the image drum of yellow is normally installed, the image drum 107 installed at the position where the image drum of magenta is normally installed, and the image drum 108 installed at the position where the image drum of cyan is normally installed, so that the image drum is stored in the use drum information. When the image drums 105, 106, 107 and 108 are in the empty state, the second use image drum determination unit 507 determines that the remaining image drum of black (K) as the image drum to be used, and registers the information in the SRAM in the first use image drum determination unit 502.

In the uniform consumption mode, the second use image drum determination unit 507 retrieves the use drum information from the SRAM of the first use image drum determination unit 502. Then, the second use image drum determination unit 507 determines one of the image drums 106, 107 and 108 retaining toner in the largest amount, and registers the one of the image drums 106, 107 and 108 as the use drum information in the SRAM of the first use image drum determination unit 502. It is supposed that the image drum 106 installed at the position where the image drum of yellow is normally installed retains toner in the largest amount, and the image drum 106 is registered in the SRAM. In other words, the image drum retaining toner in the largest amount is used first.

In the embodiment, the toner empty state determination unit 504 is provided for detecting the remaining amount of toner in each of the toner cartridges with the remaining amount sensor, so that the toner empty state determination unit 504 determines whether each of the toner cartridges is empty. The toner empty state determination unit 504 includes a control circuit having an information processing function such as a microprocessor.

More specifically, when the printer 1 is turned on, at which the image drums 105, 106, 107 and 108 are likely replaced, or when a housing cover is opened, the toner empty state determination unit 504 is arranged to retrieve the remaining amount of toner from the toner cartridge memories 131, 132, 133 and 134 in the image drums 105, 106, 107 and 108 through a data line 506 according to the program stored in the EEPROM 141. Accordingly, the toner empty state determination unit 504 determines whether each of the toner cartridges is empty, and transmits the toner empty information to the first use image drum determination unit 502.

Further, every time when the printer 1 prints one page, an image forming portion 503 transmits the consumed amount of toner to the toner empty state determination unit 504. Accordingly, the toner empty state determination unit 504 determines whether each of the toner cartridges is empty, and transmits the toner empty information to the first use image drum determination unit 502.

In the embodiment, when the printer 1 is used as the multiple color (color) printer, the user selects the multiple color printing mode (invalidates the limited color printing mode) through the operation panel 121 shown in FIG. 8. Accordingly, the operation panel control unit 501 sets the specified color information as no specified color, and registers the specific color information in the EEPROM 141. When the first use image drum determination unit 502 receives the specified color information as no specified color, the first use image drum determination unit 502 registered data with no specified color in the SRAM in the first use image drum determination unit 502.

In the embodiment, as shown in FIG. 5, when the image forming portion 503 receives the print data from the host PC 2, the image forming portion 503 heats the fixing portion 117, and controls the transportation belt 104 to transport the printing medium 103. When the printing medium 103 is transported, the image forming portion 503 uses the image drums 150, 151, 152 and 153 in each color of cyan (C), magenta (M), yellow (Y), and black (K) to form the toner layer in each color on the photosensitive members through the electro-photography process.

More specifically, the image forming portion 503 retrieves the use drum information from the SRAM in the first use image drum determination unit 502. Since there is no specified color, the image forming portion 503 uses the LED heads 109, 110, 111 and 112 to expose the photosensitive members, thereby forming the static latent images in multiple colors according to the color information of the print data. Then, the image forming portion 503 uses the transfer portions 113, 114, 115 and 116 to transfer the toner images formed on the photosensitive members to the printing medium 103 supplied from the tray 102. Accordingly, the toner images in multiple colors are formed on the printing medium 103. Afterward, the fixing portion 117 heats and presses the toner images transferred to the printing medium 103, thereby fixing the toner images to the printing medium 103.

Figure 11:
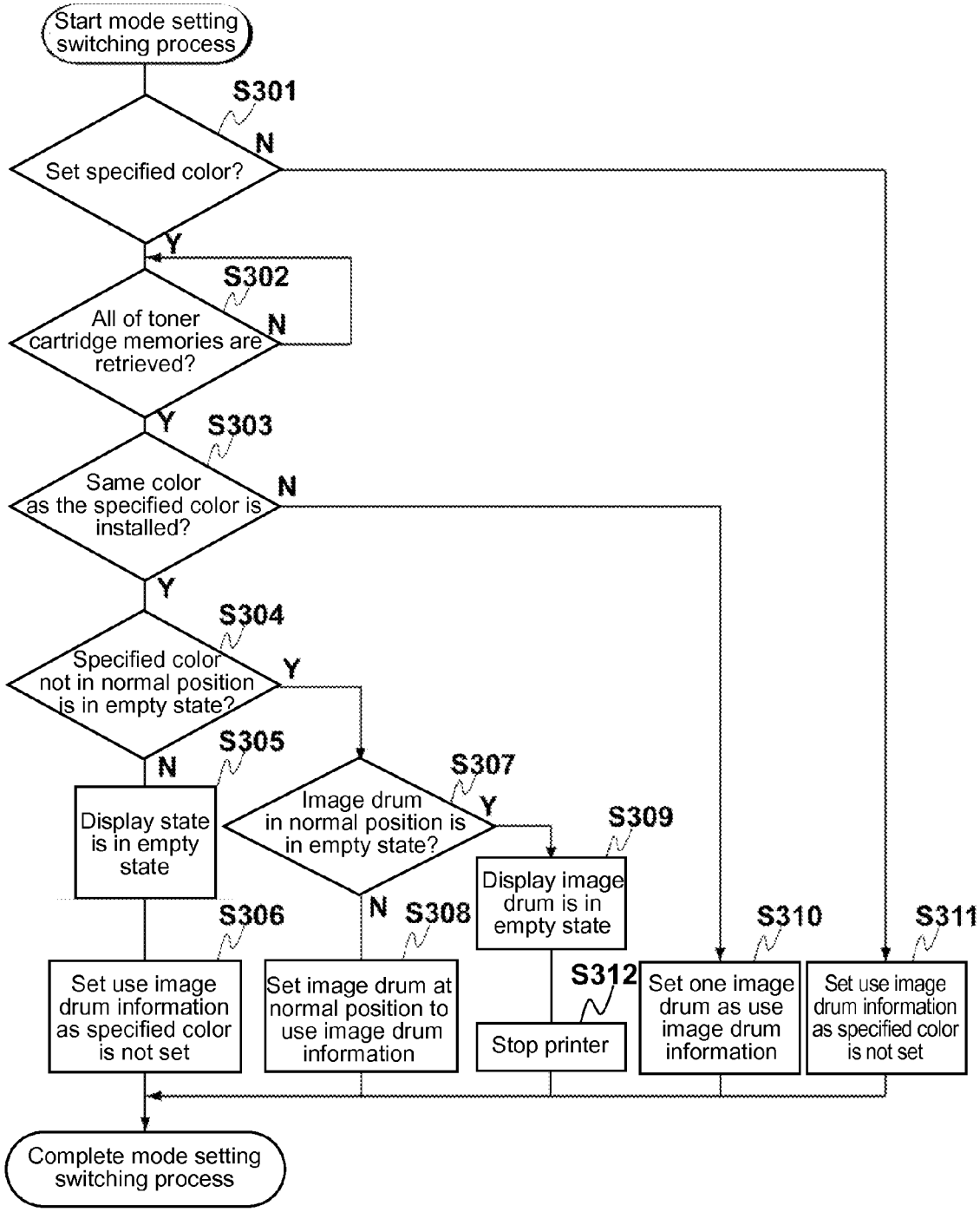
FIG. 11 is a flow chart showing an operation of the image forming apparatus in a mode setting switching process thereof according to the second embodiment of the present invention.

An operation of the printer 1 in the image drum selection process will be explained next with reference to a flow chart shown in FIG. 11. FIG. 11 is the flow chart showing the operation of the image forming apparatus in a mode setting switching process thereof according to the second embodiment of the present invention. It is noted that the printing operation of the printer 1 after the printer 1 receives the print data from the host PC 2 is similar to the flow chart in FIG. 7.

After the mode setting switching process stars, when the user switches the setting of the printing mode through the operation panel 121, the specified color information is stored in the EEPROM 141. Then, the first use image drum determination unit 502 retrieves the specified color information from the EEPROM 141. In step S301, the first use image drum determination unit 502 determines whether the specified color is set from the toner cartridge memories 131, 132, 133 and 134. In step S311, when the first use image drum determination unit 502 determines that the specified color is not set, the first use image drum determination unit 502 sets the use image drum information as that the specified color is not set, thereby completing the process. When the first use image drum determination unit 502 determines that the specified color is set, the first use image drum determination unit 502 proceeds the process to step S302.

In step S302, the first use image drum determination unit 502 determines whether all of the toner cartridge memories 131, 132, 133 and 134 are retrieved. When the first use image drum determination unit 502 determines that all of the toner cartridge memories 131, 132, 133 and 134 are not retrieved, the first use image drum determination unit 502 waits until all of the toner cartridge memories 131, 132, 133 and 134 are retrieved.

In step S303, when the first use image drum determination unit 502 determines that all of the toner cartridge memories 131, 132, 133 and 134 are retrieved in step S302, the first use image drum determination unit 502 determines whether a plurality of the image drums 106, 107 and 108 in the color same as the specified color is installed according to the color information retrieved from the toner cartridge memories 131, 132, 133 and 134. In step S310, when the first use image drum determination unit 502 determines that only one of the image drums 106, 107 and 108 is installed, the first use image drum determination unit 502 sets the one of the image drums 106, 107 and 108 as the use image drum information.

In step S304, when the first use image drum determination unit 502 determines that a plurality of the image drums 106, 107 and 108 is installed in step S303, the first use image drum determination unit 502 determines whether all of the image drums 106, 107 and 108 in the color same as the specified color and installed at positions other than the positions where the image drums 106, 107 and 108 are normally installed in the color printing operation are in the empty state.

In step S305, when the first use image drum determination unit 502 determines in step S304 that not all of the image drums 106, 107 and 108 in the color same as the specified color and installed at positions other than the positions where the image drums 106, 107 and 108 are normally installed in the color printing operation are in the empty state, the first use image drum determination unit 502 displays the state that at least one of the image drums 106, 107 and 108 is in the empty state on the operation panel 121.

In step S306, the use image drum determination unit 202 sets the image drum 106 not in the empty state and installed at a most upstream position among the image drums not in the empty state to the use image drum information.

In step S307, when the first use image drum determination unit 502 determines in step S304 that all of the image drums 106, 107 and installed at positions other than the positions where the image drums 106, 107 and 108 are normally installed in the color printing operation are in the empty state, the first use image drum determination unit 502 determines whether the image drum 105 installed at the normal position is in the empty state.

In step S308, the first use image drum determination unit 502 determines in step S307 that the image drum 105 installed at the normal position is not in the empty state, the first use image drum determination unit 502 sets the image drum 105 installed at the normal position to the use image drum information, thereby completing the process.

In step S309, when the first use image drum determination unit 502 determines in step S106 that the image drum 105 installed at the normal position is in the empty state, the first use image drum determination unit 502 controls the operation panel 121 through the operation panel control unit 201 to display that the image drum 105 is in the empty state. In step S312, the first use image drum determination unit 502 stops the printer 1, thereby completing the process.

Figure 12:
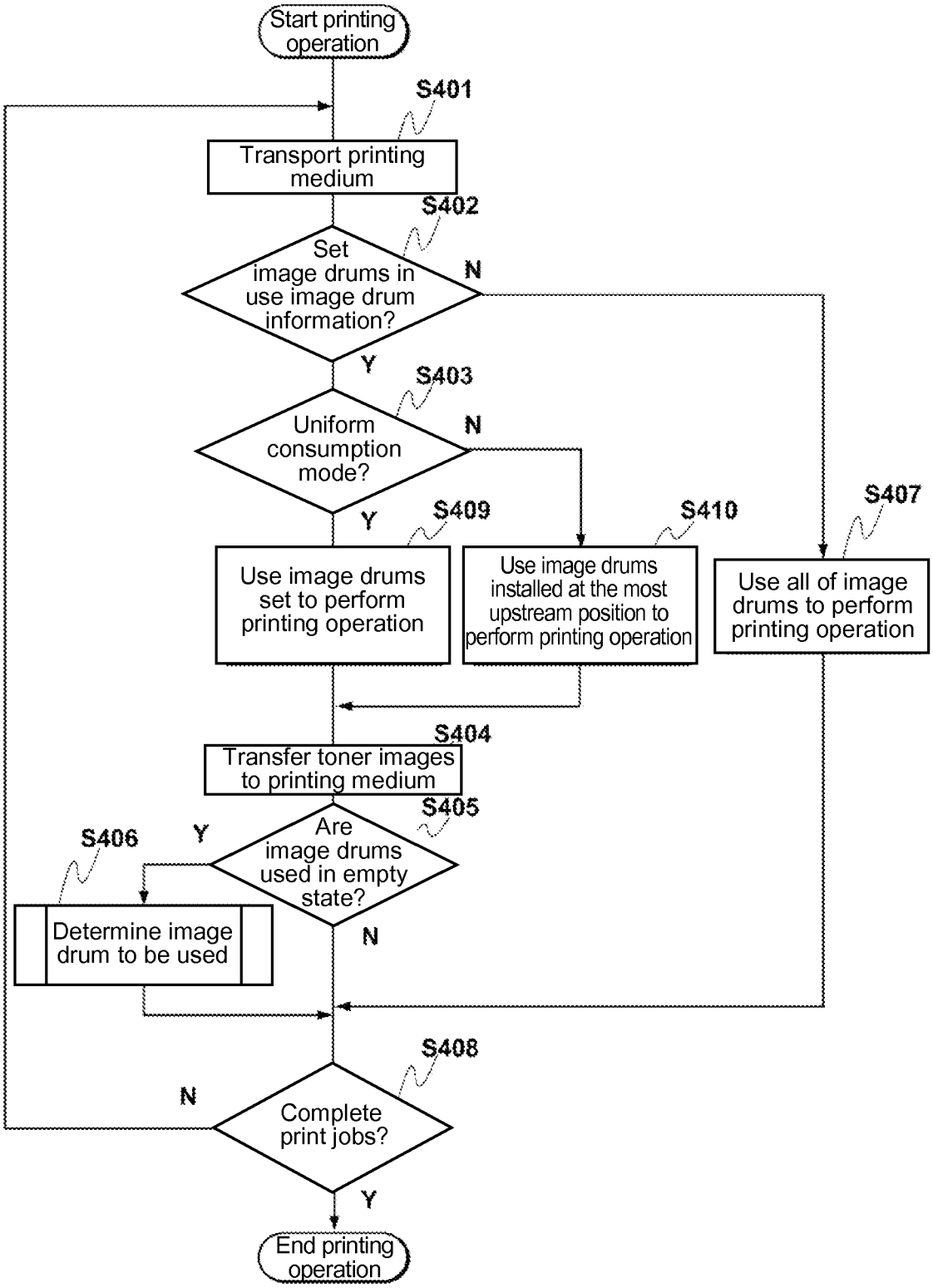
FIG. 12 is a flow chart showing an operation of the image forming apparatus in a printing operation thereof according to the second embodiment of the present invention.

The printing operation of the printer 1 will be explained next with reference to the flow chart shown in FIG. 12. FIG. 12 is a flow chart showing the operation of the image forming apparatus in the printing operation thereof according to the second embodiment of the present invention.

In step S401, when the user operates the host PC to start the printing operation, the image forming portion 503 starts the transportation belt 104 to transport the printing medium 103 from the tray 102 according to the print data. Further, the image forming portion 503 controls the second use image drum determination unit 507 to retrieve the use image drum information.

In step S402, the second use image drum determination unit 507 retrieves the use image drum information from the SRAM in the first use image drum determination unit 502, so that the second use image drum determination unit 507 determines whether the image drums 105, 106, 107 and 108 are set in the use image drum information. In step S407, when the second use image drum determination unit 507 determines that the image drums 105, 106, 107 and 108 are not set in the use image drum information, the second use image drum determination unit 507 uses all of the image drums 105, 106, 107 and 108 to perform the printing operation.

In step S403, when the second use image drum determination unit 507 determines that the image drums 106, 107 and 108 are set in the use image drum information, the second use image drum determination unit 507 determines the limited color toner consumption mode. When the second use image drum determination unit 507 determines that the limited color toner consumption mode is the uniform consumption mode, the second use image drum determination unit 507 determines one of the image drums 106, 107 and 108 retaining toner in the largest amount, and registers the one of the image drums 106, 107 and 108 to the use drum information.

In step S409, the image forming portion 503 uses the image drums 106, 107 and 108 and the LED heads 110, 111 and 112 paired with the image drums 106, 107 and 108 thus set in the second use image drum determination unit 507 to perform the printing operation.

In step S410, when the second use image drum determination unit 507 determines that the limited color toner consumption mode is the sequential consumption mode, the second use image drum determination unit 507 sets the image drum 106 installed at the most upstream position among the image drums 106, 107 and 108 to the use image drum information. Accordingly, the image forming portion 503 uses the image drum 106 and the LED head 110 paired with the image drum 106 thus set in the second use image drum determination unit 507 to perform the printing operation.

In step S404, the image forming portion 503 uses the transfer portions 114, 115 and 116 to transfer the toner images to the printing medium 103. In step S405, the second use image drum determination unit 507 determines whether the image drums 106, 107 and 108 thus used are in the empty state.

In step S406, when the second use image drum determination unit 507 determines that the image drums 106, 107 and 108 thus used are in the empty state, the second use image drum determination unit 507 performs the process shown in FIG. 11 to determine the image drum to be used. When the second use image drum determination unit 507 determines that the image drums 106, 107 and 108 thus used are not in the empty state, the second use image drum determination unit 507 does not change the image drum to be used. When the printer 1 performs the printing operation on the next printing medium, the second use image drum determination unit 507 determines again one of the image drums 106, 107 and 108 retaining toner in the largest amount, thereby performing the printing operation using the one of the image drums 106, 107 and 108.

In step S408, the image forming portion 503 determines whether the print jobs are completed. When the image forming portion 503 determines that the print jobs are completed, the image forming portion 503 stops the printing operation. When the image forming portion 503 determines that the print jobs are not completed, the image forming portion 503 repeats the process described above until the print jobs are completed.

As explained above, in the embodiment, it is possible to select the sequential consumption mode or the uniform consumption mode. In the sequential consumption mode, each of the image drums 106, 107 and 108, which are preferentially used in the monochrome printing operation, is sequentially used. In the uniform consumption mode, one of the image drums 106, 107 and 108 retaining toner in the largest amount is used. Accordingly, it is possible to select the case, in which the image drums 106, 107 and 108 to be used preferentially are replaced at the same time, and the case, in which each of the image drums 106, 107 and 108 is replaced when becomes the empty state.

The disclosure of Japanese Patent Application No. 2010-167074, filed on Jul. 26, 2010, is incorporated in the application by reference.

While the invention has been explained with reference to the specific embodiments of the invention, the explanation is illustrative and the invention is limited only by the appended claims.

What is claimed is:

1. An image forming apparatus performing a single color printing operation and a multiple color printing operation, comprising:

an image forming portion for mounting a first image forming unit for forming an image in a first color, said image forming portion mounting a second image forming unit for forming an image in the first color in the single color printing operation, said image forming portion mounting a third image forming unit for forming an image in a second color different from the first color in the multiple color printing operation;

a fixing portion disposed on a downstream, side of the first image forming unit, the second image forming unit, and the third image forming unit so that the second image forming unit is situated at a second furthest position from the fixing portion; and a control unit for controlling the image forming portion so that the second image forming unit is used relative to the first image forming unit in the single color printing operation, wherein said image forming portion is arranged to mount the first image forming unit at a first position, said image forming portion is arranged to mount the second image forming unit at a second position in the single color printing operation, and the third image forming unit at the second position in the multiple color printing operation, said image forming portion is arranged to mount a fourth image forming unit for forming an image in the first color at a third position in the single color printing operation, and a fifth image forming unit for forming an image in a third color different from the first color at the third position in the multiple color printing operation, said control unit is arranged to control the image forming portion so that the second image forming unit or the fourth image forming unit is used when both the second image forming unit and the fourth image forming unit not in the empty state in the single color printing operation using the first color, and said control unit is arranged to control the image forming portion so that the first image forming unit is used when both the second image forming unit and the fourth image forming unit become the empty state in the single color printing operation using the first color.

2. The image forming apparatus according to claim 1, wherein said image forming portion is arranged to mount the first image forming unit for forming the image in black as the first color.

3. The image forming apparatus according to claim 1, wherein said image forming portion is arranged to mount the third image forming unit for forming the image in one of cyan, magenta, and yellow as the second color.

4. The image forming apparatus according to claim 1, wherein said control unit is arranged to control the image forming portion so that the second image forming unit is preferentially used relative to the first image forming unit in the single color printing operation when the second image forming unit retains developer.

5. The image forming apparatus according to claim 1, wherein said control unit is arranged to control the image forming portion so that the first image forming unit is used in the single color printing operation when the second image forming unit becomes the empty state.

6. The image forming apparatus according to claim 1, wherein said control unit is arranged to notify warning when the second image forming unit becomes the empty state.

7. The image forming apparatus according to claim 1, wherein said image forming portion is arranged to mount a fourth image forming unit for forming an image in the first color in the single color printing operation, said control unit being arranged to notify warning and control the image forming portion so that the fourth image forming unit is used when the second image forming unit becomes the empty state.

8. The image forming apparatus according to claim 7, wherein said control unit is arranged to control the image forming portion so that the first image forming unit is used when the second image forming unit and the fourth image forming unit become the empty state.

9. The image forming apparatus according to claim 1, wherein said image forming portion is arranged to mount a fourth image forming unit for forming an image in the first color in the single color printing operation, said control unit being arranged to control the image forming portion so that one of the second image forming unit and the fourth image forming unit is used when the one of the second image forming unit and the fourth image forming unit retains developer more than the other of the second image forming unit and the fourth image forming unit.

10. The image forming apparatus according to claim 9, wherein said control unit is arranged to control the image forming portion so that the first image forming unit is used when the second image forming unit and the fourth image forming unit become the empty state.

11. The image forming apparatus according to claim 1, wherein said image forming portion further includes a first transfer portion at a position below the first position for transferring a developer image formed with the first image forming unit to a medium, said image forming portion further includes a second transfer portion at a position below the second position for transferring a developer image formed with the second image forming unit or the third image forming unit to the medium, and said image forming portion further includes a third transfer portion at a position below the third position for transferring a developer image formed with the fourth image forming unit or the fifth image forming unit to the medium.

12. The image forming apparatus according to claim 1, further comprising:

a belt disposed to face the first image forming unit and the second image forming unit; and a transfer portion for transferring a developer image from the image forming portion toward the belt, wherein said first image forming unit is arranged on an upstream side of the second image forming unit to form an image in black, and said belt is arranged to transport a medium from the one of the first image forming units toward the fixing portion.

* * * * *